United States Patent [19]

Hottle

[11] Patent Number: 4,919,324

[45] Date of Patent: Apr. 24, 1990

[54] ENVELOPE

[76] Inventor: Dwight E. Hottle, 2866 Lakeland Pkwy., Stow, Ohio 44224

[21] Appl. No.: 289,777

[22] Filed: Dec. 27, 1988

[51] Int. Cl.[5] ..... B65D 27/00

[52] U.S. Cl. ..... 229/68 R

[58] Field of Search ..... 229/68 R, 75, 92.8

[56] References Cited

U.S. PATENT DOCUMENTS 1,171,323 2/1916 D'Agostino ..... 229/75

1,343,075 6/1920 Benedict ..... 229/68 R 1,897,602 2/1933 Bayer ..... 229/75

*Primary Examiner*—Stephen P. Garbe

*Attorney, Agent, or Firm*—Reese Taylor

[57] ABSTRACT

A mailing envelope having a stamp receiving area recessed in one planar surface. The stamp receiving area provides a stamp receiving surface which is dimensioned so as to receive a postage stamp or postage meter tape and is disposed beneath the one planar surface a distance at least equal to the thickness of the stamp or tape.

2 Claims, 1 Drawing Sheet

ENVELOPE

BACKGROUND OF THE INVENTION

This invention relates in general to mailing envelopes and relates in particular to an improved mailing envelope having a stamp receiving recess therein so as to avoid inadvertent separation between the stamp and the envelope during processing and transmission thereof.

DESCRIPTION OF THE PRIOR ART

In the mailing industry, it is, of course, well-known that postage stamps are affixed to an indicia receiving surface on the front of envelopes. These stamps are then cancelled with a postmark.

Formerly, stamps were cancelled by hand and with that method the problem of the stamps inadvertently becoming separated from the envelope was fairly minimal. It has been estimated that manual stamping created an impact on the stamp somewhat similar to a car hitting a brick wall at 5 miles per hour. Regardless of the actual impact, the problem was not particularly serious.

However, with the advent of automatic sorting machines and automatic cancellation of stamps, the envelopes are passed through mating rolls at relatively high speeds. Furthermore, these machines accelerate and decelerate quite rapidly. Using the same analogy, it has now been estimated that the impact on the stamp is similar to a car hitting a brick wall at 60 miles an hour with automated systems.

Stated quite frankly, because of the impact on the stamp and the rapid acceleration and deceleration of the machines, when the envelope stops, the stamp wants to continue and the result is often dislodgement of the stamp from the envelope.

Various approaches to the solution to this problem have been attempted. The most common approach has been to improve the quality of the adhesive which is received on the rear of the stamp. Even with such an improvement, however, the possibility of tearing or catching an edge of the stamp still exists.

Examples of the general envelope art can be seen in D'Agostino U.S. Pat. No. 1,171,323 and Bayer U.S. Pat. No. 1,897,602. However, obviously neither of these patents disclose envelope construction which would avoid the problem referred to above.

SUMMARY OF THE INVENTION

It has been found that the problems referred to above can be resolved by providing the envelope with a stamp receiving recess so that the stamp is disposed on the envelope with its top surface being below the plane of the front or indicia receiving surface of the envelope itself. In this fashion, it has been discovered that when the envelope passes through an automatic sorting machine, the rolls of the machine do not come in contact with the stamp at all, thereby avoiding any inadvertent damage or destruction of the stamp.

Accordingly, production of an improved envelope of the type abovedescribed becomes the principal object of the invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

The improved envelope is generally indicated by the numeral 10 and includes a front surface 11 and a rear surface 12. These surfaces, in the form of the invention illustrated, are formed from a single piece and are cut, folded and glued into a conventional envelope construction, although, of course, they could be separate pieces glued together if desired.

The front surface 11 constitutes an indicia receiving surface to receive indicia 13, such as address and return address.

Figure 1:
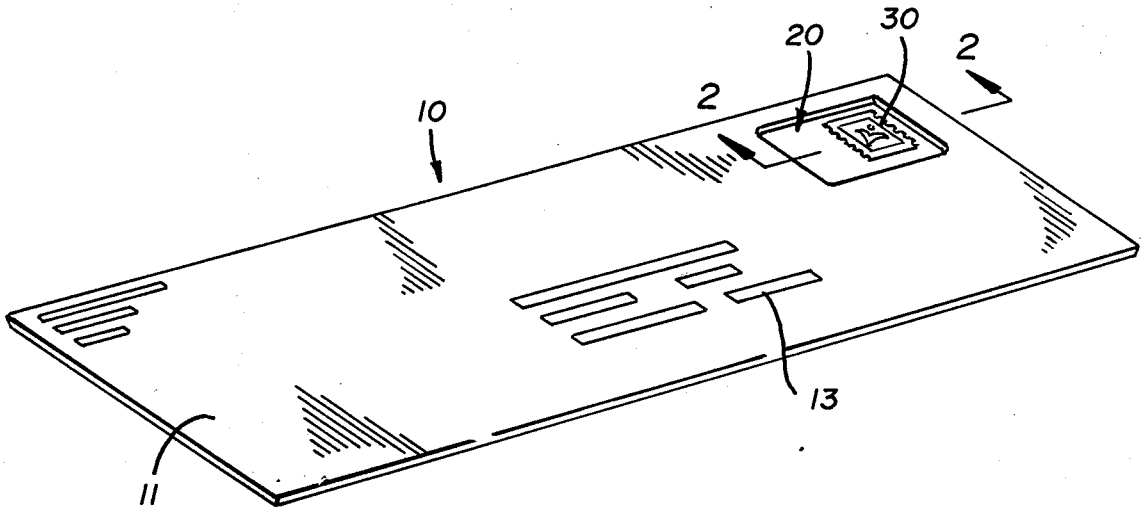
FIG. 1 is a perspective view showing the improved envelope.
Figure 2:
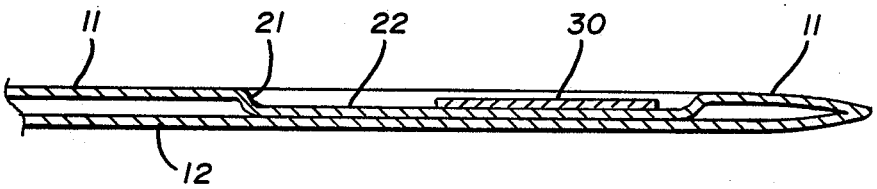
FIG. 2 is a sectional view taken along the line 2—2 of FIG. 1.

The stamp 30, of course, as is conventional, is affixed to the envelope in the upper right hand corner as one views the front surface 11 and as is shown in FIG. 1 of the drawings.

The improvement resides in the stamp receiving recess 20 which is recessed toward the rear wall 12 a distance slightly greater than the thickness of a conventional stamp.

As shown in the drawings, this recess is formed by depressing the front surface 11 to form a perimeter wall 21 which generally takes a rectangular configuration and is generally sized so as to accommodate conventional sizes of stamps. The perimeter wall 21 is integral with a bottom wall 22 which, as previously mentioned, lies in a plane parallel to the plane of the indicia receiving front surface 11, but disposed beneath that plane a distance equal to or slightly greater than the normal thickness dimension of a conventional stamp 30. It will be noted here that the recess illustrated in the drawings is generally rectangular in plan, but could take other planar configurations if desired.

As will be apparent, if the envelope 10 is passed through sorting rollers of a conventional type well-known to those of ordinary skill in this art and therefore not illustrated, the rollers will pass along the front and rear surfaces 11 and 12 of envelope 10, but will either not come into contact with the stamp 30 which is recessed below the plane of those surfaces or will not come into contact with the edge surfaces thereof. In that way, inadvertent damage or dislodgement of the stamp will be avoided.

While a full and complete description of the invention has been set forth in accordance with the dictates of the Patent Statutes, it will be understood that modifications can be resorted to without departing from the spirit hereof or the scope of the appended claims.

Thus, it should be noted that the envelope illustrated in the drawings represents a conventional "letter size" or No. 10 envelope. However, the inventive concept disclosed and claimed herein would have applicability to any size envelope.

Furthermore, the size of the stamp receiving indentation or depression has not been specified, although it would preferably be large enough to accommodate the largest of the most commonly used stamps. It could also be dimensioned, mostly for larger size envelopes, to accommodate postage meter tapes. Therefore, reference to "stamp receiving" herein is intended to include postage meter tapes or any other similar articles.

What is claimed is:

1. An envelope, comprising an imperforate forward indicia receiving surface having a recessed postage receiving area formed therein; said postage receiving area including a generally rectangular perimeter wall extending inwardly from said imperforate indicia receiving surface and a bottom wall integral with said perimeter wall.

2. An envelope, comprising an imperforate forward indicia receiving surface having a recessed postage receiving area formed therein; said postage receiving area including a perimeter wall extending inwardly from said imperforate indicia receiving surface and a bottom wall integral with said perimeter wall; and said bottom wall being disposed below said indicia receiving surface a distance at least equal to the thickness of a postage stamp.

* * * * *